US006003520A

United States Patent [19]

Ford

[11] Patent Number: 6,003,520

[45] Date of Patent: Dec. 21, 1999

[54] HAIR STYLING ACCESSORY AND METHOD OF USE

[76] Inventor: Judit K. Ford, 12406 El Oro Way, Granada Hills, Calif. 91344

[21] Appl. No.: 09/200,207

[22] Filed: Nov. 25, 1998

[51] Int. Cl.[6] ..... A45D 2/18

[52] U.S. Cl. ..... 132/247

[58] Field of Search ..... 132/200, 273, 132/247, 246

[56] References Cited

U.S. PATENT DOCUMENTS

| | | | |
|---|---|---|---|
| D. 182,016 | 2/1958 | Dean . | |
| D. 206,206 | 11/1966 | Battaglia . | |
| D. 216,753 | 3/1970 | Long, Jr. . | |
| D. 247,858 | 5/1978 | Moya . | |
| D. 258,541 | 3/1981 | Featherstone . | |
| D. 269,044 | 5/1983 | Battaglia . | |
| D. 282,293 | 1/1986 | Harvey . | |
| D. 290,065 | 6/1987 | Battaglia . | |
| D. 307,808 | 5/1990 | Cabiddu . | |
| D. 330,781 | 11/1992 | Balster et al. . | |
| D. 365,173 | 12/1995 | Ford . | |
| D. 388,539 | 12/1997 | Ford . | |
| 672,506 | 4/1901 | Godward | 132/247 |
| 876,402 | 1/1908 | Schacht | 132/247 |
| 1,847,826 | 3/1932 | Fraser et al. | 132/247 |
| 1,945,932 | 2/1934 | Caley | 132/247 |
| 2,154,501 | 4/1939 | Feldman | 132/247 |
| 2,225,590 | 12/1940 | Huppert . | |
| 2,378,872 | 6/1945 | Stone | 132/247 |
| 2,415,914 | 2/1947 | Silverman | 132/247 |
| 2,627,275 | 2/1953 | Kiviluoma | 132/246 |
| 3,324,865 | 6/1967 | Battaglia . | |
| 3,464,427 | 9/1969 | Abraham . | |
| 4,239,050 | 12/1980 | Leussi . | |
| 4,310,008 | 1/1982 | Lalli . | |
| 4,520,831 | 6/1985 | Schumann et al. . | |
| 4,612,944 | 9/1986 | Bachrach et al. . | |
| 4,984,590 | 1/1991 | Bachtell . | |
| 5,025,816 | 6/1991 | Jones . | |

FOREIGN PATENT DOCUMENTS

| | | | |
|---|---|---|---|
| 796222 | 4/1936 | France | 132/247 |

OTHER PUBLICATIONS

"Hong Kong Enterprise" Oct. 1989; p. 702; comb indicated by arrow.

"Hong Kong Enterprises" Oct. 1991; p. 477 second row, left comb indicated by arrow.

*Primary Examiner*—Todd E. Manahan

*Attorney, Agent, or Firm*—Kelly Bauersfeld Lowry & Kelley, LLP

[57] ABSTRACT

A resiliently flexible and deformable hair styling accessory which imparts waves and style to hair, includes an elongated body and a head integrally formed at a first end of the body. The head includes an aperture which is configured to allow the forcible insertion of a second end of the elongated body therethrough and to thereafter retain a portion of the elongated body therein. The elongated body and head may form a unitary body constructed of a plurality of material components laminated along a longitudinal axis of the body. In use, a portion of wetted hair is rolled onto the elongated body and the second end is forcibly pushed through the aperture, retaining the elongated body and rolled hair in place. Once the hair has dried sufficiently to achieve the desired style, the inserted portion of the elongated body is withdrawn from the head aperture and the hair styling accessory is released from the hair.

13 Claims, 1 Drawing Sheet

HAIR STYLING ACCESSORY AND METHOD OF USE

BACKGROUND OF THE INVENTION

This invention relates to hair styling products and styling techniques. More specifically, the present invention relates to a resiliently flexible and deformable hair styling accessory which gives hair waves and style easily and conveniently.

The use of various products and devices to affect the style of hair are well known. There are various methods of "permanently" styling one's hair by using kits or visiting the beauty salon where the hair is chemically treated to achieve the desired style. Although the style is not permanent, it can last several weeks or months. Thus, the same hair style must be worn for this time period. This method is often time consuming and expensive, and the chemicals used in permanents may damage the hair.

As an alternative, many people use hot curlers or a curling iron to add waves and curls to their hair when styling. In this manner, the hair may be styled on a day-by-day basis. However, these methods can damage the hair as the hair is heat treated. Moreover, the hot curlers or curling iron can potentially burn the user on the scalp or hand, or a third person such as a child who accidently touches the hot curler or iron. Curling one's hair requires electricity, and thus a conveniently placed outlet, to heat the iron or curlers. The hairstylist must oftentimes wait for the curlers or iron to heat up to the necessary temperature. Wearing curlers at night can be painful as they are typically made of metal or hard plastic. Traveling with a set of curlers and heating apparatus is inconvenient as they require a lot of space and may break while transported.

Therefore, there is a need for a hair styling apparatus and related method which will not damage hair, which can be used without requiring access to an electrical outlet, is conveniently used when traveling, and is easy to use and inexpensive. The present invention fulfills these needs and provides other related advantages.

SUMMARY OF THE INVENTION

The present invention resides in a hair styling accessory which conveniently creates waves and other hair styles. The accessory includes a resiliently flexible and deformable head and an elongated body having a generally uniform cross-section. The head is attached at a first end of the elongated body and includes an aperture which is configured to permit the forcible insertion of a second end of the elongated body. The second end of the elongated body may have a reduced cross-section to facilitate the insertion of the body through the aperture. The head may include an extension protruding opposite the elongated body which acts as a handle, facilitating the manipulation of the hair styling accessory.

Preferably, the head is integrally formed with the elongated body. This unitary body of the elongated body and the head includes a plurality of resiliently flexible and deformable material components which are aligned and adjoined by lamination along a longitudinal axis of the hair styling accessory. The utilization of multiple layers of material components cause the body to naturally bend and twist about the length of its axis when manipulated.

In use, the hair is wetted and partially dried. A selected portion of the hair is rolled onto the hair styling accessory's elongated body. After the hair is rolled, the second end of the body is pushed through the aperture of the head. The elongated body is retained in the aperture and the rolled hair is securely held place. The hair is allowed to dry, and the styling accessory removed by withdrawing the second end of the elongated body from the aperture and releasing the hair. This results in the hair having more waves and style than it previously had. The hair may be further styled by use of a brush or hair dryer, if desired. For longer lasting hair styles, a gel or mousse is added to the hair prior to rolling the selected portion of hair onto the styling accessory.

BRIEF DESCRIPTION OF THE DRAWINGS

The accompanying drawings illustrate the invention. In such drawings:

FIGS. 3–6 are rear elevational schematic representations of a head of hair, and illustrate the method of using the hair styling accessory of FIG. 1, wherein:

FIG. 3 illustrates the selection of a portion of hair to be rolled onto the hair styling accessory;

FIG. 4 illustrates the step of rolling the selected portion of hair onto an elongated body of the hair styling accessory;

FIG. 5 illustrates the insertion of a narrowed second end of the elongated body into an aperture of a head of the hair styling accessory; and FIG. 6 illustrates the hair rolled onto the hair styling accessory and the second end inserted through the aperture of the head, the elongated body being retained in the aperture, and thus the retention of the rolled hair on the hair styling accessory.

DETAILED DESCRIPTION OF THE PREFERRED EMBODIMENT

Figure 1:
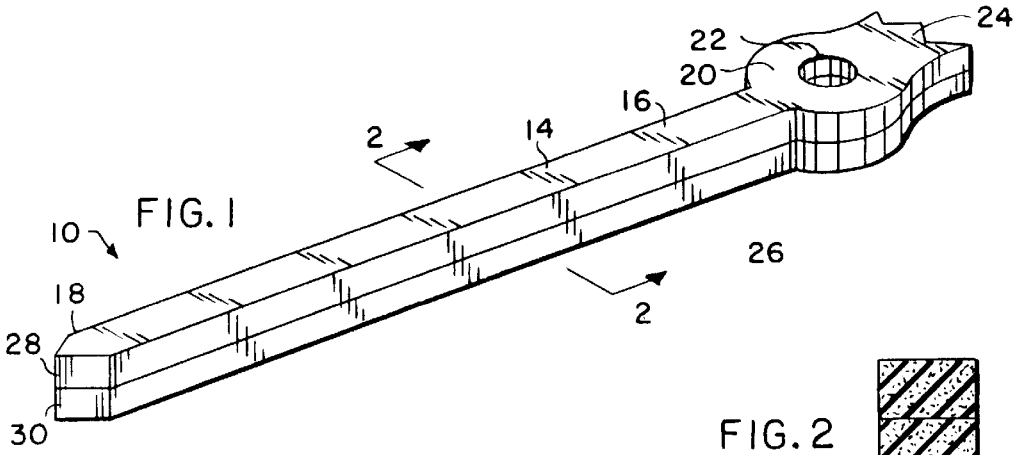
FIG. 1 is an end, top and side perspective view of a hair styling accessory embodying the present invention.

As shown in the drawings for purposes of illustration, the present invention is concerned with a hair styling accessory, generally designated by the reference number 10. The hair styling accessory 10 is intended to be rolled onto portions of hair 12, imparting and creating waves and other styles to the hair 12.

Figure 2:
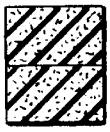
FIG. 2 is an enlarged sectional view taken generally along line 2—2 of FIG. 1.

With reference to FIGS. 1 and 2, the hair styling accessory 10 includes a resiliently flexible and deformable elongated body 14 having a first end 16 and a second end 18. The elongated body 14 has a generally uniform cross-section. The first end 16 of the elongated body 14 has a head 20 attached thereto. The head 20 has an aperture 22 which is configured to permit the second end 18 of the elongated body 14 to be forcibly pushed through it. The aperture 22 and second end 18 are necessarily deformed from their original shape when the second end 18 of the elongated body 14 is pushed through as the second end 18 is somewhat larger in diameter than the aperture 22. The resulting tight fit retains the elongated body 14 in the aperture 22 after the body 14 has been inserted therethrough.

The second end 18 may be narrowed or pointed by reducing the cross-section, aiding in the insertion of the elongated body 14 through the aperture 22. The head 20 may also have an extended portion 24 opposite the first end 16 which acts as a handle, aiding the hairstylist in manipulating the hair styling accessory 10. This extension 24 may be of an aesthetically pleasing design or shape.

Preferably, and as shown in the drawings, the head 20 and the elongated body 14 are integrally formed and comprise a unitary body 26. The unitary body 26 includes a plurality of resiliently flexible and deformable material components 28, 30. These components 28, 30 are joined along the longitudinal axis of the unitary body 22 and laminated to one another. Utilization of the plurality of components 28, 30 imparts a natural bend or twist to the elongated body 14 when the second end 18 is forcibly inserted through the aperture 22. This bending and twisting gives the hair even more waves and style. The plurality of components 28, 30 may be different colors for aesthetic purposes.

In use, a portion of hair 12 is selected and rolled onto the elongated body 14 of the hair styling accessory 10. The second end 18 of the elongated body 14 is then pushed through the aperture 22 of the head 20. The elongated body 14 is retained in place in the aperture 22, thus the hair 12 is remains rolled.

Figure 3:
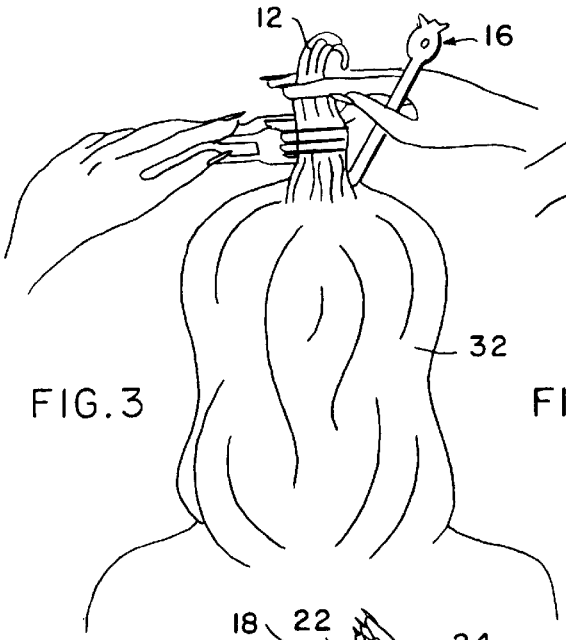

FIG. 3 illustrates selecting a portion of hair 12 which is raised from the user's head 32 in order to be rolled onto the hair styling accessory 10. Typically, the hair 12 is wetted and partially dried before use.

Figure 4:
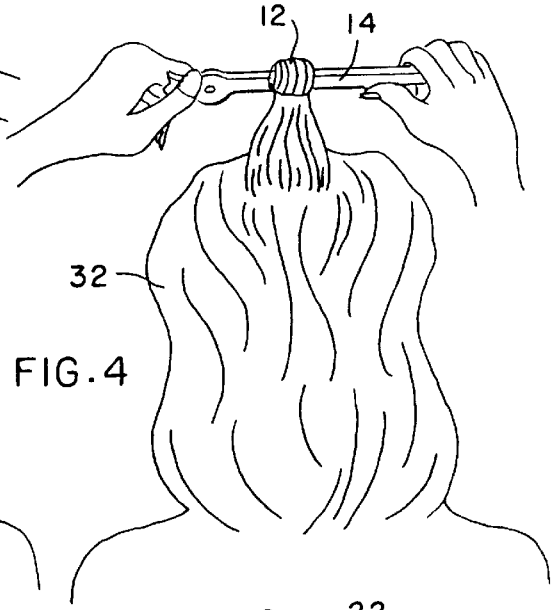

FIG. 4 shows the selected portion of hair 12 being rolled onto the elongated body 14 of the hair styling accessory 10. The hair 10 may be partially rolled or completely and tightly rolled to alter the type of waves and style.

Figure 5:
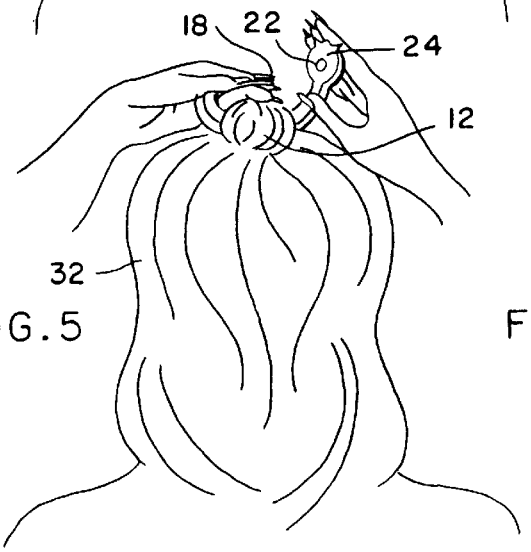

FIG. 5 demonstrates the second end 18 of the elongated body 14 being inserted through the aperture 22 with the aid of the handle-like extended head portion 24.

Figure 6:
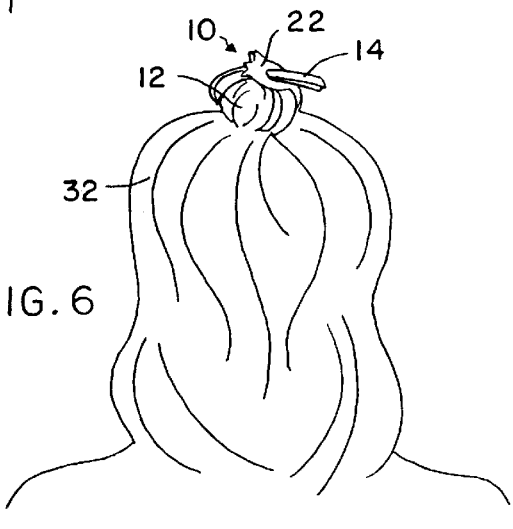

FIG. 6 illustrates the elongated body 14 being retained in the aperture 22, which securely holds the rolled hair 12 in place.

Once the hair 12 is dry, the elongated body 14 is removed from the aperture 22 and the hair 12 is released. The hair 12 will have a more wavy style as a result of this process. Gel and styling mousse can be applied to the hair 12 before rolling it on the body 14 of the styling accessory 10 for a longer lasting style. The hairstyle may also be manipulated by using a comb, brush, hair dryer or any other hair styling product to achieve the desired result.

Use of the present invention is advantageous as compared to other methods as a person may select different hairstyles from day to day. The hair styling accessory 10 may be used for most lengths of hair 12 and the hair 12 is not damaged by using this method and device. The user may even wear the hair styling accessories 10 to bed at night as they are flexible and comfortable to wear. When traveling, use of the present invention is convenient as the styling accessory units 10 are small, do not require a heating apparatus and do not easily break. The method of using the hair styling accessory 10 is easy, comparatively fast and inexpensive.

Although the description set forth above describes in detail the present invention for purposes of illustration, various modifications may be made without departing from the spirit and scope of the invention. Accordingly, the invention is not to be limited, except as by the appended claims.

What is claimed is:

1. A hair styling accessory, comprising:

an elongated body of generally uniform cross-section and comprised of a plurality of resiliently flexible and deformable material components laminated to one another; and a head attached at a first end of the elongated body and comprised of a plurality of resiliently flexible and deformable material components laminated to one another, the head having an aperture configured to permit forcible insertion of a second end of the elongated body therethrough and to thereafter retain a portion of the elongated body therein.

2. The hair styling accessory of claim 1, wherein the head includes an extension protruding therefrom opposite the elongated body, which extension serves as a handle for the hair styling accessory.

3. The hair styling accessory of claim 1, wherein the second end of the elongated body is of reduced cross-section relative to the remainder of the elongated body, to facilitate its forcible insertion through the head aperture.

4. The hair styling accessory of claim 1, wherein the elongated body and the head are integrally formed with one another and comprise a unitary body.

5. The hair styling accessory of claim 4, wherein the plurality of resiliently flexible and deformable material components laminated to one another are joined along a longitudinal axis of the hairstyling accessory.

6. The hair styling accessory of claim 5, wherein the unitary body is formed of one or more elastomeric materials.

7. A hair styling accessory, comprising:

a resiliently flexible and deformable elongated body of generally uniform cross-section; and a resiliently flexible and deformable head integrally formed at a first end of the elongated body, the head having an aperture configured to permit forcible insertion of a second end of the elongated body therethrough and to thereafter retain a portion of the elongated body therein, and an extension protruding therefrom opposite the elongated body which serves as a handle for the hairstyling accessory;

wherein the second end of the elongated body is of reduced cross-section relative to the remainder of the elongated body to facilitate its forcible insertion through the head aperture; and wherein the elongated body and the head comprise a unitary body including a plurality of resiliently flexible and deformable material components adjoined along a longitudinal axis of the hair styling accessory and laminated to one another.

8. The hair styling accessory of claim 7, wherein the unitary body is formed of one or more elastomeric materials.

9. A method for styling hair, comprising the steps of:

providing a resiliently flexible and deformable hair styling accessory including an elongated body of uniform cross-section and a head integrally formed at a first end of the elongated body, wherein the head has an aperture configured to permit insertion of a second end of the elongated body therethrough, the elongated body and the head comprising a plurality of resiliently flexible and deformable material components laminated to one another;

rolling hair onto the elongated body of the hair styling accessory;

with the hair rolled about the elongated body, forcibly inserting the second end of the elongated body through the aperture; and retaining a portion of the elongated body within the aperture.

10. The method of claim 9, wherein the hair is wetted and partially dried and a portion of hair is selected for rolling onto the elongated body.

11. The method of claim 10, wherein the hair styling accessory is removed when the hair is dry by withdrawing the elongated body from the aperture and removing the hair styling accessory from the hair.

12. The method of claim 10, wherein gel or mousse is applied to the hair before rolling the selected portion onto the elongated member.

13. The method of claim 9, wherein the step of forcibly inserting the second end of the elongated body is facilitated by reducing the cross-section of the second end of the elongated body and incorporating a handle-like extension protruding from the head.

* * * * *